United States Patent [19]

Kerstein

[11] Patent Number: 4,861,018

[45] Date of Patent: Aug. 29, 1989

[54] IDLER RELEASE PULLEY LEVER MECHANISM FOR DOCUMENT TRANSPORT

[75] Inventor: Melvin Kerstein, Lincolnwood, Ill.

[73] Assignee: Bell & Howell Co., Skokie, Ill.

[21] Appl. No.: 199,951

[22] Filed: May 26, 1988

[51] Int. Cl.[4] ..... B65H 5/06

[52] U.S. Cl. ..... 271/274

[58] Field of Search ..... 271/274, 273, 272

[56] References Cited

U.S. PATENT DOCUMENTS

| | | | |
|---|---|---|---|
| 3,756,589 | 9/1973 | Carbine | 271/274 |
| 4,522,520 | 6/1985 | Takenoya | 271/274 X |
| 4,674,735 | 6/1987 | Dubois | 271/274 X |

*Primary Examiner*—Richard A. Schacher

*Attorney, Agent, or Firm*—Laff, Whitesel, Conte & Saret

[57] ABSTRACT

A document transport system for transporting documents of varying thicknesses along a document path comprising a document drive assembly forming one side of the document path, an idler roller assembly forming an opposite side of the document path, the document drive assembly including a moving belt adapted to engage each document and move each document along the document path, the idler roller assembly including a plurality of idler rollers adapted to move automatically and manually, alternately, between a first position contacting the moving belt when no documents are present in the document path and contacting the documents when present in the document path, and a second position out of contact with the moving belt or the documents, thereby forming a gap between the idler rollers and the moving belt, the idler rollers being connected by a lost motion connection to an idler release lever, whereby the idler release lever remains stationary when the idler rollers move automatically between the first position and the second position, and whereby actuation of the idler release lever causes movement of the idler rollers from the first position to the second position to permit the clearance of jams in the document path.

7 Claims, 5 Drawing Sheets

IDLER RELEASE PULLEY LEVER MECHANISM FOR DOCUMENT TRANSPORT

The present invention relates generally to a document drive mechanism, and in particular to an idler roller release pulley device which provides a lost motion mechanism permitting idler rollers in a document drive system to be self adjustable to allow the facile transport of various size documents and allow the manual clearance of document jams, without repetitive and unnecessary movement of the manual operating lever of the release system.

BACKGROUND OF THE INVENTION

The conduct of business today requires the efficient and rapid handling and movement of documents. Documents, such as mail envelopes by way of example, often must be machine read, coded, transported and sorted for rapid delivery from the generator of the document to its recipient. In certain apparatus, once the content of a document is read or deciphered, further handling applies a machine readable code to the document face, the code is machine read, and the document is then sorted by being mechanically deposited in a pre-designated bin. The designation of the bin may be a function of the code imprinted on the document. All of these functions are preferably performed while the document is travelling at very high speeds, such as 150 to 200 inches per second, through the document handling apparatus.

One such document handling apparatus of the type described above, which is described here by way of example, is used by the postal service in its facilities to (1) rapidly feed mail envelopes into an optical scanning device which reads the address printed on the envelope and selects a nine digit zip code corresponding to the address from a digitized national zip code directory stored in memory, (2) print a bar code on the envelope corresponding to the zip code selected from the data storage bank, (3) read the bar code to verify its accuracy, and (4) deposit the envelope in a depository or bin which receives and sorts the mail corresponding to the zip code read by the optical reader and imprinted on the envelope. The present invention relates to the document transport mechanism used in the sorter portion of the apparatus.

Prior sorting devices of the type described comprise an elongated linear moving flat belt upon which a series of envelopes (or other documents) are upright and singularly disposed. The sorter also comprises a series of opposed drive belt and idler roller assemblies which defines the path of the envelopes, and transports the envelopes to their appropriate bin. Each of these assemblies comprises a driving belt support on one side of the document path, and an idler roller support on the other side of the document path. The driving belt support includes a driving belt extending around a plurality of rollers, one of which is connected to a power source to rotate the driven roller and move the belt around the rollers. A portion of the moving belt extends in a linear direction above the horizontally extending belt and is adapted to abut one surface of the envelope along a predetermined extent, approximately 8 to 12 inches.

The idler roller support is disposed on the opposite side of the document path relative to the drive roller support, and includes a plurality of idler rollers mounted for horizontal rotation in the same plane, and adjacent the moving belt of the driving belt support. The idler rollers are adapted to contact the opposite face of the document which is in contact with the feed belt, whereby the document is substantially firmly held between the feed belt and the idler rollers.

At the end of the document path defined by each pair of opposed driving belt support and idler roller support are pairs of deflectors which are mechanically operated responsive to electronic sensing of the appropriate destination of the document to either (1) direct a document out of the document path described above and into a storage receptacle or bin, or (2) allow the document to pass along the document path into the next serially disposed drive belt and idler roller assemblies. The combinations of deflectors and drive belt and idler roller assemblies along the document path are substantially identical.

Since mail of various thicknesses must be transported and handled along the sorter document path described above, the width component of the document path must be variable, yet maintained under tension to grip the documents. Also, the distance between the feed belt and the idler rollers must be capable of manual release by an operator to clear up any document jam that may occur between the belt and idler rollers. Prior devices of this type rely on the resilient structure of the rollers to compensate for variable document thickness, and upon rigid lever connections to the idler rollers to withdraw the idler rollers in the event of a jam. These structures create two problems in high speed document transport systems which must be addressed: (1) the resiliency of the rollers and belt is incapable of making adjustments for various sized envelopes travelling at high speeds because the deformation of the rollers required by such mechanisms does not recover fast enough, causes jams, and tends to slow down the speed of document transport. Also, as the documents move along the document path at high speeds, the manual lever operating the jam control mechanism will constantly chatter back and forth, causing undesirable noise and wear and tear on the lever mechanism and its attendant parts.

Therefore, a primary object of the present invention is to provide a document transport system having opposed drive belt and idler roller assemblies which provide a variable width for the document path as documents of variable thickness are engaged and gripped between the moving belt and the idler rollers, without any of the shortcomings of the currently available devices noted above.

Yet another object of the present invention is to provide an idler roller assembly for a document transport system, which assembly includes a manually operated jam release lever which is operatively connected to the idler rollers through a lost motion connection in one direction, whereby movement and chatter of the lever arm is prevented upon normal operation of the document transport system.

An additional object of the invention is to provide a moveable idler roller support mechanism for a document transport system including moveable pivot mountings for the idler rollers which allow the idler rollers to move laterally to compensate for documents of varying thicknesses passing through the document transport system, and a manually operable lever operatively connected by a series of pulley and cable connections to the idler roller supports, whereby actuation of the lever arm causes corresponding movement of the idler rollers in a lateral direction, but lateral movement of the idler rollers under the influence of documents of varying thickness passing through the transport system does not cause corresponding movement or chatter of the manual lever arm.

SUMMARY OF THE INVENTION

These and other objects of the present invention are accomplished by document transport system which includes a document drive belt assembly forming one side of a document path and an idler roller assembly forming the opposite side of the document path. The belt assembly includes a moving belt adapted to engage each document and move the document along the document path. The idler roller assembly includes a plurality of idler rollers which alternately are adapted to automatically or manually move from a first position towards the belt assembly, and to a second position away from the belt assembly, thereby creating a gap between the moving belt and the idler rollers in the second position. When the gap is formed, jammed documents can readily be removed from the document path. When documents are in the document path, the idler rollers engage each document when the idler rollers are in the first position. If no documents are present, the idler rollers abut the moving belt when in the first position.

A manually operated idler release lever is provided to manually move the idler rollers to their second position in the event of a jam. A lost motion connection extends between the idler release lever and each idler roller support arm. Each idler roller support arm is pivoted from the idler roller assembly, whereby each idler roller moves in an arcuate path between the respective first and second positions. Each idler roller support arm is connected to an idler roller release pulley, which moves with the support arm. The lost motion connection includes flexible cables extending between a lever arm release pulley attached to the idler release lever, and each of the idler roller release pulleys. The cables transmit motion only when under tension, and not when under compression, at which time the cables slack.

With the above construction, under normal operation of the document transport system of the present invention, documents of varying sizes are continuously fed along the document path. The distance between the drive belt and the idler rollers is automatically adjusted under the influence of the arcuate rotation allowed by the pivotal mounting of the arms supporting the idler rollers, and under the influence of spring elements urging the idler rollers into contact with the documents. As the idler rollers move in and out, and the idler roller release pulleys attached to each idler arm supporting shaft responsively rotate, the cable connection to the lever arm release pulley slacks, and no force is applied to the idler release lever. Therefore, as documents continually and rapidly move along the document path, and the idler rollers quickly move in an out, there is no movement or chatter of the idler release lever. This eliminates a potential source of noise during operation of the document transport system, and also prevents the idler release lever mechanism from wearing out before its time.

If manual clearance of a document jam is required, actuation of the idler release lever causes tension in the cables between the lever arm release pulley and the idler roller release pulleys, and the movement of the lever is transmitted to the idler arms which, in turn, move the idler rollers to their second position, creating a gap in the document path and allowing the jammed documents to be cleared. Upon release of the idler release lever, the idler rollers reassume their operative position.

DESCRIPTION OF THE PREFERRED EMBODIMENT

Figure 1:
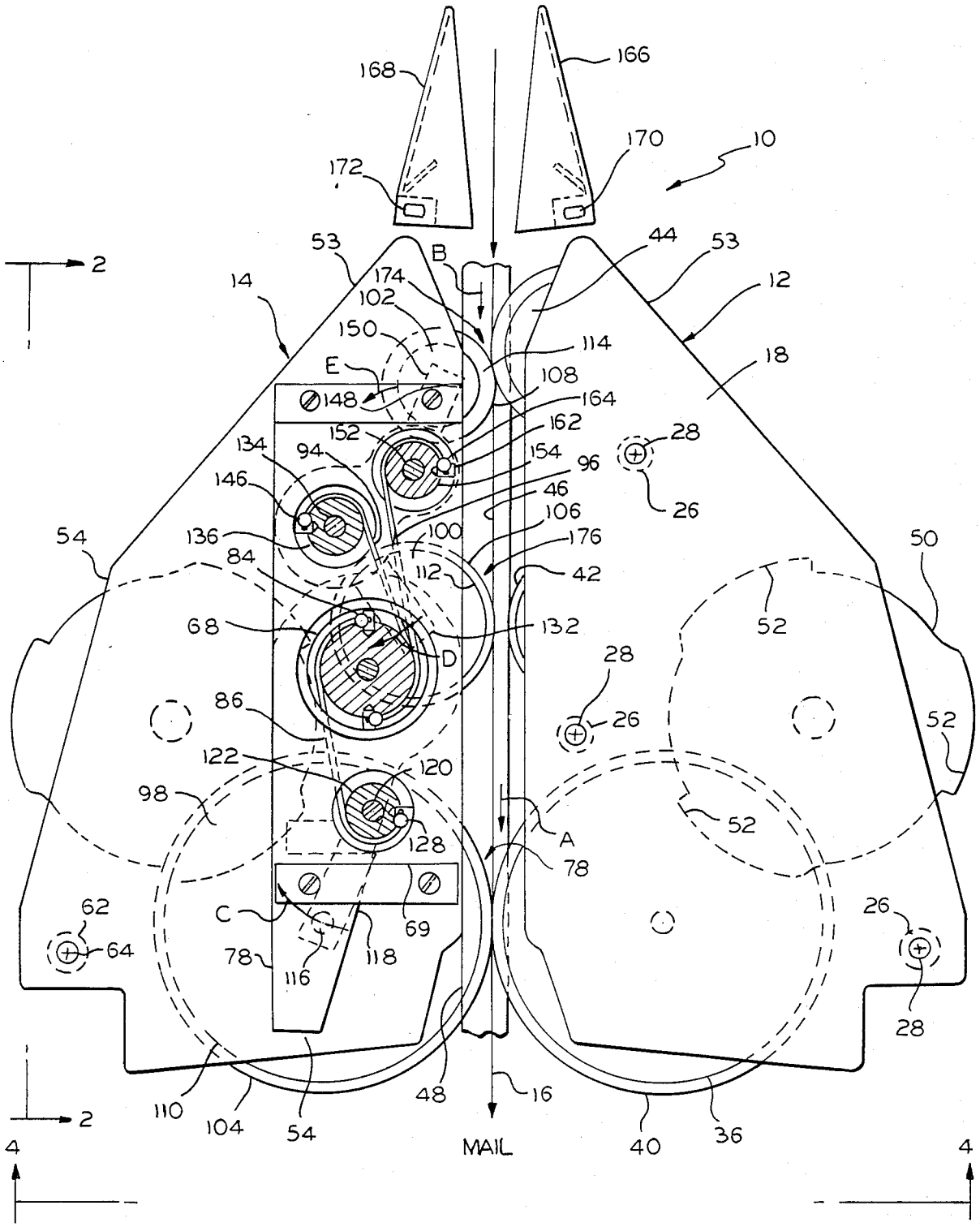
FIG. 1 is a plan view of the opposed drive belt and idler roller assemblies of the present invention which define a portion of a document path showing the idler rollers, idler arms, idler roller release pulleys, and attendant interconnections as if the cover plate over these elements were removed.

Referring now to the drawing wherein similar numbers are utilized to designate similar parts, and particularly to FIG. 1, the document transport system of which the embodiment of the present invention forms a part is generally designated by the numeral 10, and includes opposed drive belt assembly 12 and idler roller assembly 14, which are laterally spaced apart forming a document path therebetween, indicated by line 16. In the description of the preferred embodiment, the documents travelling in document path 16 comprise envelopes and other pieces of mail. However, it is to be understood that the present invention also contemplates handling other types of documents.

Figure 4:
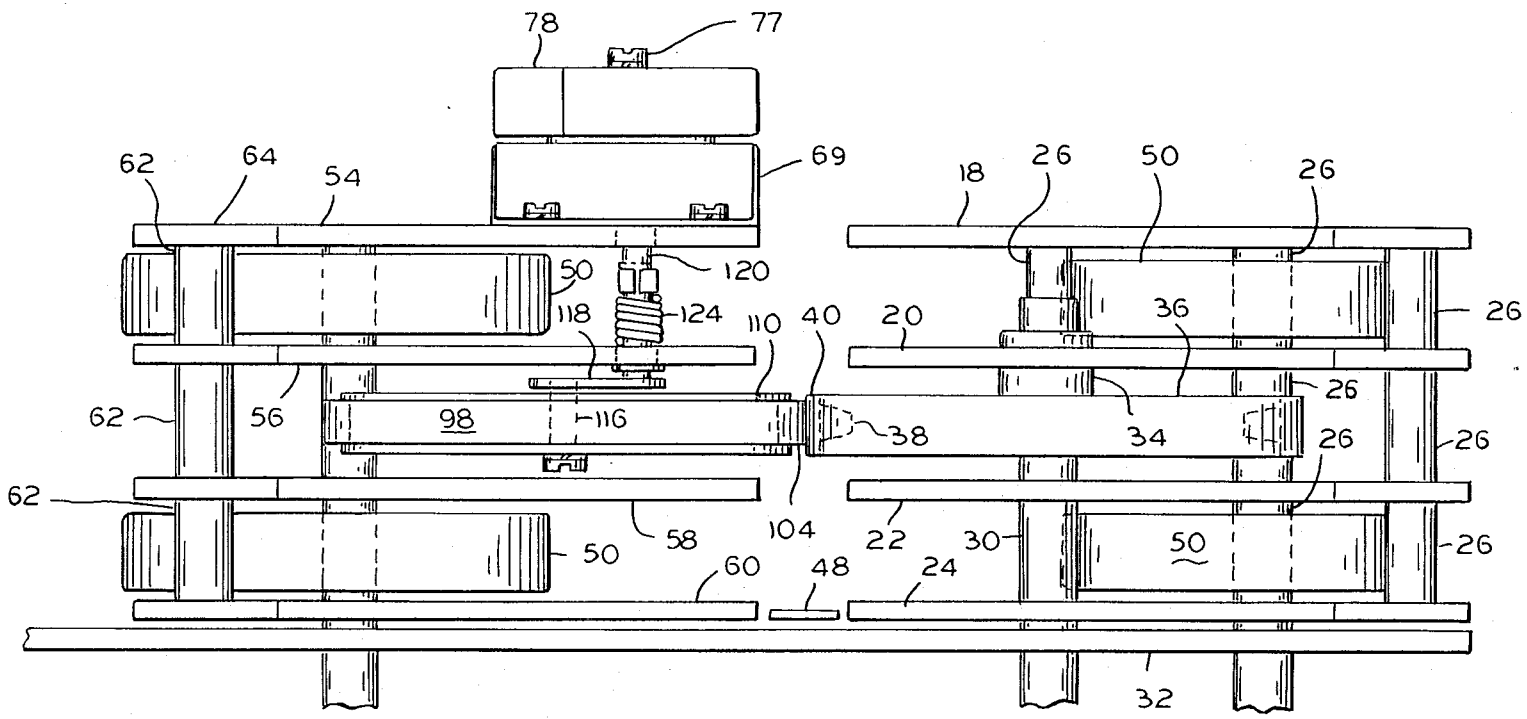
FIG. 4 is a side elevational view of the opposed drive belt and idler roller assemblies of FIG. 1 taken along line 4—4 of FIG. 1.

The drive belt assembly 12 of the desired embodiment comprises four stacked guide plates 18, 20, 22 and 24, as best seen in FIG. 4. The guide plates are maintained apart at substantially equal intervals by spacers 26 mounted around a plurality of vertically extending posts 28. Drive shaft 30 extends upward from base plate 32 (upon which drive belt assembly 12 is mounted) through guide plates 24, 22 and 20, the latter including a bearing 34 in which shaft 30 is appropriately journalled. A V-pulley assembly 36 is mounted between guide plates 20 and 22 for rotation with shaft 30, and includes a groove 38 at the perimeter thereof which receives the inner surface of a resilient mail transport belt 40. Belt 40 is preferably made of rubber, but may also be composed of any other suitable material which provides the appropriate force to drive documents along document path 16. As seen in FIG. 4, the outer (left) side of V-pulley assembly 36 and belt 40 extend beyond the edge of guide plates 18, 20, 22 and 24, and into document path 16 (FIG. 1). Suitable drive means (not shown) are connected to shaft 30 to drive V-pulley assembly and shaft 30, as will be explained. If desired, driven rollers or other suitable means can be substituted for belt 40.

Referring to FIG. 1, belt 40 extends from V-pulley assembly 36 over idler pulleys 42 and 44, which are also mounted for free rotation between guide plates 20 and 22, and are co-planar with V-pulley assembly 36. Belt 40 extends in a linear horizontal plane between pulleys 36, 42 and 44, providing a vertical document driving surface 46 adjacent document path 16. When shaft 30 is rotated, belt 40 is driven in the direction indicated by arrow A in FIG. 1.

A flat horizontally disposed belt 48 is disposed at the bottom of document path 16 just above base plate 32, and is driven in the direction indicated by the arrow B in FIG. 1. Belt 48 also provides a driving force advancing the envelopes along document path 16, and forming a bottom reference plane for the documents as they are transported along the document path. Belt 48 also passes along the bottom of the document path between serially disposed pairs of drive belt assembly 12 and idler roller assembly 14 to form an extended document path 16.

A pair of document beaters 50 are rotatively disposed between guide plates 22, 24 and 18, 20 respectively. Each beater 50 includes a plurality of cammed surfaces 52 which are adapted to jostle and assist in stacking mail pieces which are deflected into storage bins disposed adjacent the outer edges 53 (FIG. 1) of drive belt assembly 12 and idler roller assembly 14, respectively, as will be explained.

Figure 2:
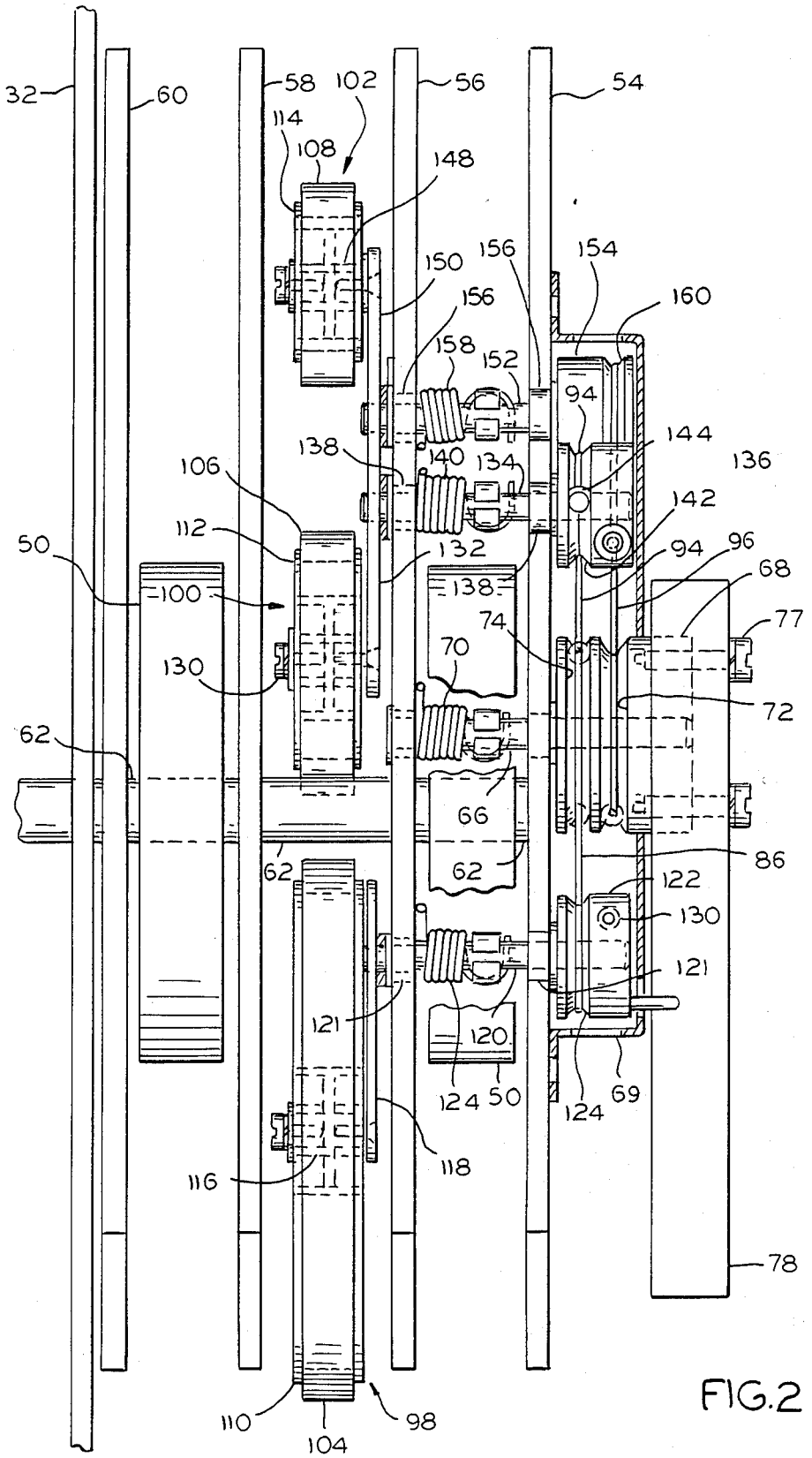
FIG. 2 is a sectional elevation view of the idler roller assembly of FIG. 1 taken along line 2—2 of FIG. 1.

Forming the opposing side of document path 16 in document transport system 10 is idler roller assembly 14 comprising four stacked guide plates 54, 56, 58 and 60 maintained apart at substantially equal intervals by spacers 62 mounted around a plurality of vertically extending posts 64, as best seen in FIGS. 1, 2 and 4. Mounted on top of guide plate 54 and fixed to a shaft 66 is lever arm release pulley 68. A cover 69 (FIG. 4) extends over the lever arm release pulley, and shaft 66 extends upward through an opening in cover 69. Shaft 66 extends through and is journalled for rotation in guide plates 54 and 56. A spring loaded bias mechanism 70 urges the lever arm release pulley in the counterclockwise direction, as viewed in FIG. 1.

Figure 5:
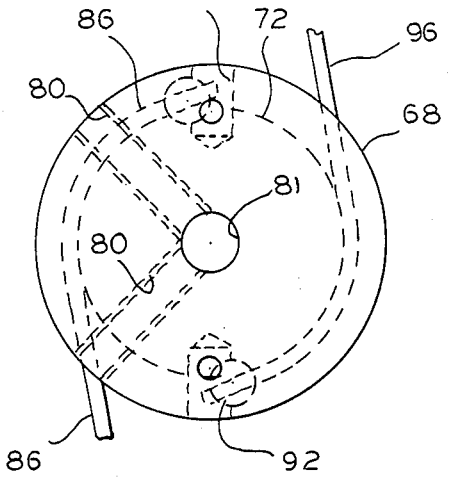
FIGS. 5(*a*), 5(*b*) and 5(*c*) are plan and side elevational detail views of the lever arm release pulley and cable attachments forming part of the present invention.
Figure 5:
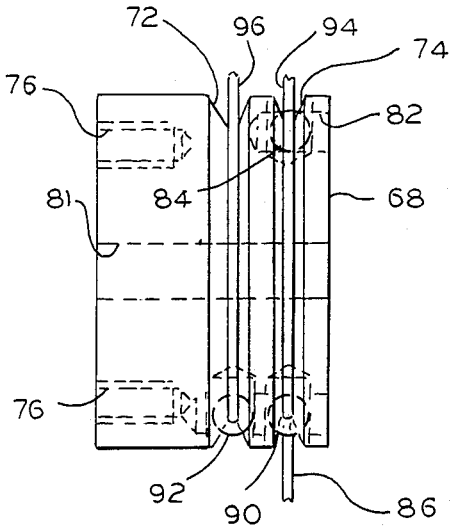

Lever arm release pulley 68 comprises a pair of side by side circumferential grooves 72, 74 (FIG. 2). As shown in detail in FIGS. 2, 5(*a*), 5(*b*) and 5(*c*), threaded apertures 76 are provided in pulley 68 to receive screws 77 or other suitable means to attach pulley 68 rigidly to idler release lever 78, which is adapted for manual operation as will be explained. Threaded ports 80 are also provided in the body of pulley 68 to receive set screws to rigidly attach pulley 68 to shaft 66, which extends into central aperture 81.

Figure 5C:
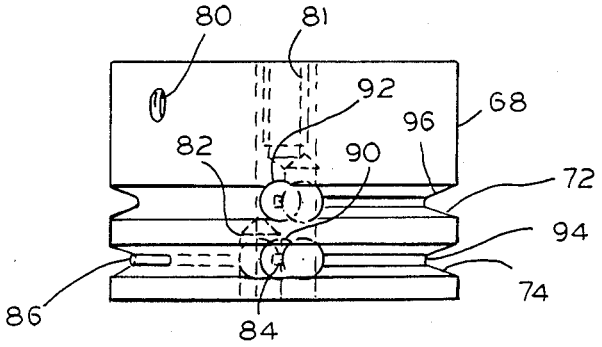

Groove 74 includes an aperture 82 which is adapted to hold a clevis pin 84 attached to one end of cable 86. A second aperture 88 disposed approximately 180° around pulley 68 from aperture 82 extends across both grooves 72 and 74, providing means to hold clevis pins 90 and 92, as seen in FIG. 5(c). Cable 94 is attached to clevis pin 90, and cable 96 is attached to clevis pin 92. It is apparent that rotation of lever arm release pulley 68 in the clockwise direction, as viewed in FIGS. 1 and 5(*a*), will cause cables 86 an 94 to be wound along opposite portions of groove 74, and cable 96 to be wound along groove 72.

Idler roller assembly 14 also includes a plurality of idler rollers 98, 100, 102 which comprise rubber wheels 104, 106, 108 between idler pulley assemblies 110, 112, 114, respectively (FIGS. 1, 2). As seen in FIG. 1, the outer circumference of each of rubber wheels 104, 106, 108 is adapted in a first position to tangentially abut belt 40 to form the document path 14. As will be explained, each idler roller 98, 100, 102 is adapted to be automatically moved away from contact with belt 40 to allow the passage of mail, or manually moved from contact with belt 40 to clear jams in the document path. As seen in FIG. 2, each idler roller is mounted between guide plates 56 and 58.

With reference to FIGS. 1 and 2, idler roller 98 is centrally and rotatably mounted on a shaft 116 which is attached to idler arm 118. The other end of idler arm 118 is rigidly mounted to a shaft 120 which extends through guide plates 56 and 54 and has idler roller release pulley 122 attached thereto for rotation with the shaft 120. Shaft 120 is journalled for rotation in the guide plates by means of bearings 121 (FIG. 2). Spring 124 biases shaft 120 in the counter-clockwise direction, as viewed in FIG. 1.

Figure 6:
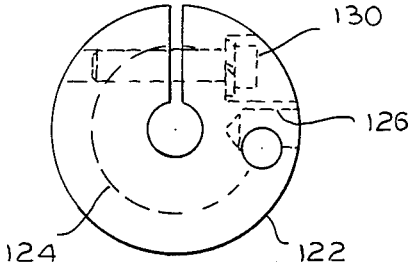
FIGS. 6(*a*) and 6(*b*) are plan and side elevational detail views of the idler roller release pulleys forming part of the present invention.
Figure 6:
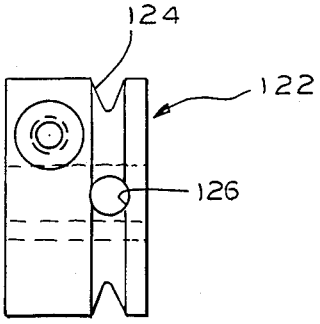

FIGS. 6(*a*) and 6(*b*) are detail views of idler roller release pulley 122, which includes a circumferential groove 124 and an aperture 126 which is adapted to secure a clevis pin 128 (FIG. 1) to pulley 122. The end of cable 86 is attached to clevis pin 128, and cable 26 partially winds around pulley 122 in groove 124, as seen in FIG. 1. Fastening element 130 is provided in pulley 122 to secure the pulley to shaft 120. It is apparent that rotation of idler roller release pulley 122 in the clockwise direction (FIG. 1) will cause idler arm 118 to rotate clockwise, thereby moving shaft 116 along the arc designated by the arrow C and withdrawing idler roller 98 from contact with belt 40. As described previously, the other end of cable 86 is attached to lever arm release pulley 68.

Idler roller 100 is centrally and rotatably mounted on a shaft 130 which is attached to idler arm 132. The other end of idler arm 132 is rigidly mounted to a shaft 134 which extends through guide plates 56 and 54 and has idler roller release pulley 136 fixed thereto for rotation with shaft 134. Shaft 134 is journalled for rotation in guide plates 54, 56 by means of bearings 138. Spring 140 biases shaft 134 in the counterclockwise direction, as viewed in FIG. 1.

The construction of idler roller release pulley 136 is preferably similar to idler roller release pulley 122, described above with reference to FIGS. 6(*a*) and 6(*b*). Pulley 136 includes a circumferential groove 142 and an aperture 144 which is adapted to secure a clevis pin 146 (FIG. 1) to pulley 136. An end of cable 94 is attached to clevis pin 146, and partially winds around pulley 136, as seen in FIG. 1. It is apparent that rotation of idler roller release pulley 136 in the clockwise direction (FIG. 1) will cause idler arm 132 to rotate clockwise, thereby moving shaft 130 along the arc designated by the arrow D and withdrawing idler roller 100 from contact with belt 40. As described previously, the other end of cable 94 is attached to lever arm release pulley 68.

Idler roller 102 is centrally and rotatably mounted on a shaft 148 which is attached to idler arm 150. The other end of idler arm 150 is rigidly mounted to a shaft 152 which extends through guide plates 56 and 54 and has idler roller release pulley 154 fixed thereto for rotation with shaft 152. Shaft 152 is journalled for rotation in guide plates 54 and 56 by means of bearings 156. Spring 158 biases shaft 152 in the clockwise direction, as viewed in FIG. 1.

The construction of idler roller release pulley 154 is preferably similar to idler roller release pulley 122, described above with reference to FIGS. 6(*a*) and 6(*b*). Pulley 154 includes a circumferential groove 160 and an aperture 162 which is adapted to secure a clevis pin 164 (FIG. 1) to pulley 154. An end of cable 96 is attached to clevis pin 164, and partially winds around pulley 154, as seen in FIG. 1. It is apparent that rotation of idler roller release pulley 154 in the counterclockwise direction (FIG. 1) will cause idler arm 150 to rotate counter-clockwise about shaft 152, thereby moving shaft 148 along the arc designated by the arrow E and withdrawing idler roller 102 from contact with belt 40. As described previously, the other end of cable 96 is attached to lever arm release pulley 68.

A pair of document deflector gates 166, 168 are located at the entrance of the document path 14 as the documents begin their passage between drive belt assembly 12 and roller assembly 14. Referring to FIG. 1, if a document is to be stored in the bin at the right side of drive belt assembly 12, deflector 166 is rotated slightly counter-clockwise about pivot 170, whereby the outer tip of deflector 166 crosses document path 16. Thus, any document approaching deflector 166 will be transported due to its own inertia into the area adjacent outer edge 53 of the guide plates forming drive belt assembly 12. Beater 50 then jostles the documents in this storage area, providing a neat and compact stack of envelopes, which are removed and forwarded for further processing and delivery.

Deflector 168 operates in somewhat the same manner to deflect designated documents into the storage area adjacent outer edge 53 of the guide plates forming idler roller assembly 14. If a document is to be so deflected, deflector 168 rotates slightly clockwise about pivot 172 (FIG. 1), whereby the tip of the deflector crosses document path 16. Advancing documents will then be transported and stacked in the area adjacent outer edge 53 of idler roller assembly 14 in the manner described in the preceding paragraph.

The operation of the document transport system 10 comprising drive belt assembly 12 and idler roller assembly 14 assumes that deflector gates 166, 168 are each programmed to remain in their open position, as shown in FIG. 1, whereby documents are urged forward by horizontal belt 48 and the velocity imparted to the documents by a series of prior document transport stations, some similar to that disclosed herein, and through which the documents have previously passed. The documents then serially pass along the document path 16 and between open gates 166, 168.

The documents each initially engage the nip 174 between belt 40 and idler roller 102. Due to the thickness of the document, and the thickness of each document may vary, idler roller 102 is urged to the left (FIG. 1) causing idler arm 150 to move in the arc E about shaft 152. Shaft 152 rotates slightly against the tension of spring 158, and also slightly rotates idler roller release pulley 154 counter-clockwise, as viewed in FIG. 1. Spring 158, acting on shaft 152, normally applies the pressure necessary to urge idler roller 102 into contact with belt 40 when no documents are in document path 16, and into contact with the documents when they are in the document path.

The counter-clockwise rotation of pulley 154 causes cable 96 to slightly unwind from groove 160, and since cable 96 is flexible, the cable slacks and no force is transmitted to lever arm release pulley 68. Pulley 68 does not rotate and idler release lever 78 remains stationary under the influence of spring 70.

As the trailing edge of the document passes out of nip 174, spring 158 urges shaft 152, idler arm 150 and idler roller 102 to the right (FIG. 1), causing idler roller 102 to again abut belt 40. Cable 96 reassumes its taut position in groove 160 of pulley 154. The movement of belt 40 (arrow A) causes idler roller 102 to rotate freely about shaft 148, in the same manner that each of idler rollers 98 and 100 also freely rotate about their central shafts 120 and 134 when the rollers abut moving belt 40. In this position, each idler roller forms a nip between itself and belt 40 which is adapted to receive each ensuing document in path 16.

As the leading edge of the documents reach nip 176 formed between belt 40 and idler roller 100, idler roller 100 is urged to the left (FIG. 1), causing idler arm 132 to move in arc D about shaft 134. Shaft 134 rotates slightly against the tension of spring 140, and also slightly rotates idler roller release pulley 136 clockwise, as viewed in FIG. 1. Spring 140, acting on shaft 134, normally applies the pressure necessary to urge idler roller 100 into contact with belt 40 when no documents are in document path 16, and into contact with the documents when they are in the document path.

The clockwise rotation of pulley 136 causes cable 94 to slightly unwind from groove 142, and since cable 94 is flexible, the cable slacks and no force is transmitted to lever arm release pulley 68. Pulley 68 therefore does not rotate, and idler lever 78 remains stationary. As the trailing edge of the document passes out of nip 176, spring 140 urges shaft 130 and idler roller 100 to the right (FIG. 1), causing idler roller 100 to again abut belt 40. Cable 94 reassumes its taut position in groove 142 of pulley 136.

The leading edge of each document next reaches nip 178 formed between belt 40 and idler roller 98. Idler roller 98 is urged to the left (FIG. 1), causing idler arm 118 to move in arc C about shaft 120. Shaft 120 rotates slightly against the tension of spring 124, and also slightly rotates idler roller release pulley 122 clockwise, as viewed in FIG. 1. Spring 124, acting on shaft 120, normally applies the pressure necessary to urge idler roller 98 into contact with belt 40 when no documents are in document path 16, and into contact with the documents when they are in the document path.

The clockwise rotation of pulley 122 cause cable 86 to slightly unwind from groove 124, and since cable 86 is flexible, the cable slacks and no force is transmitted to lever arm release pulley 68. Pulley 68 therefore does not rotate, and idler release lever 78 remains stationary. As the trailing edge of the document passes out of nip 178, spring 124 urges shaft 116 and idler roller 98 to the right (FIG. 1), causing idler roller 98 to again abut belt 40. Cable 86 reassumes its taut position in groove 124 of pulley 122.

Thus, from the operation described above, the present invention provides a structure which allows documents of varying width to pass through the document path 16 while idler rollers move back and forth automatically to simultaneously adjust for documents of varying widths, and maintain the pressure on the documents and moving belt 40 that is necessary to firmly grip the documents between the drive belt assembly 12 and the idler roller assembly 14 for rapid and efficient transport. With the lost motion connection provided by cables 86, 94, and 96 between the idler roller release pulleys 122, 136 and 154, and the lever arm release pulley 68, the motion of idler rollers 98, 100 and 102 is not transmitted to idler release lever 78 as the rollers automatically adjust for document width.

Figure 3:
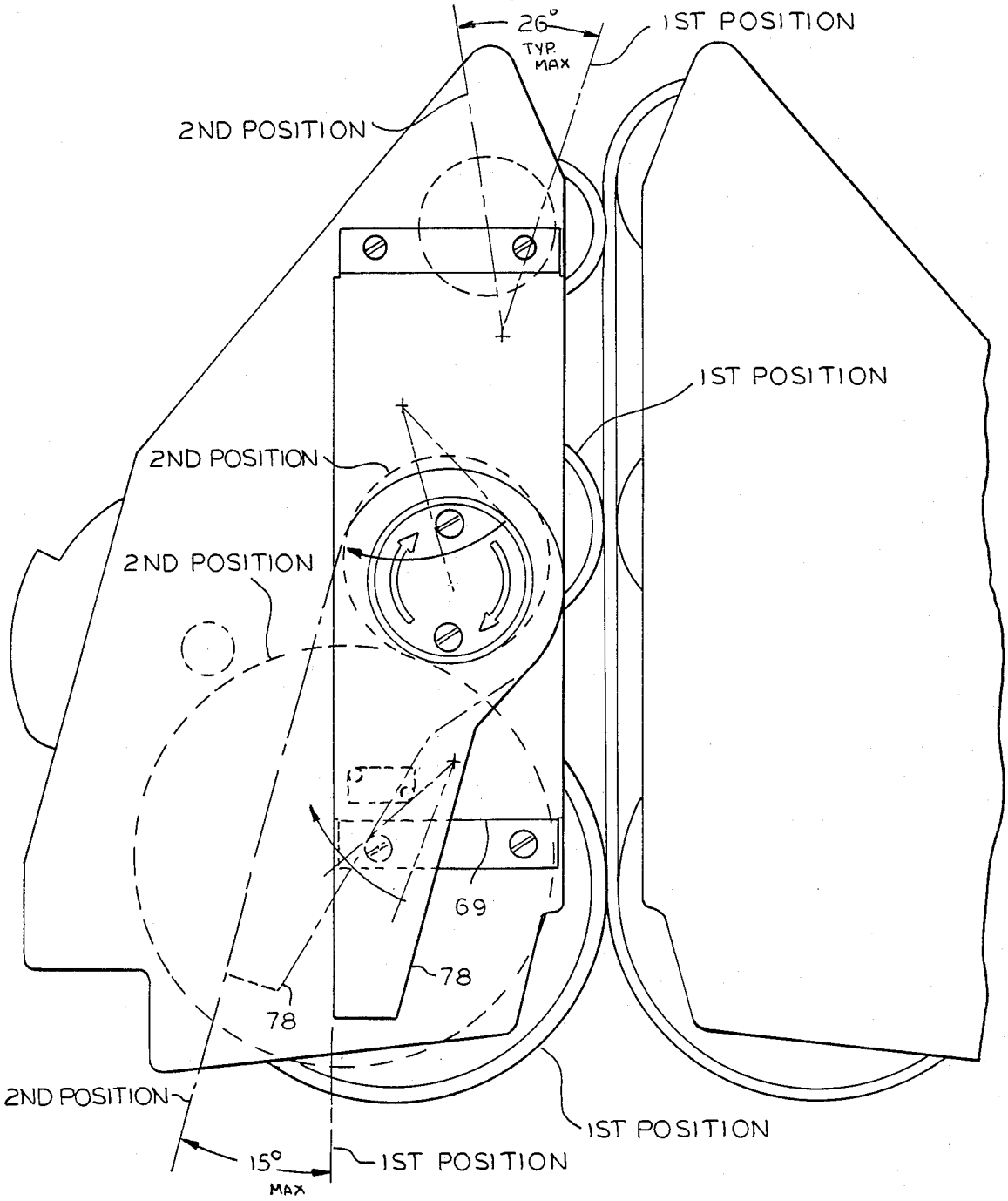
FIG. 3 is a top plan view of the opposed drive belt and idler roller assemblies of the present invention, showing the idler release lever and the idler rollers in their two maximum rotative positions.

In the event a series of documents jam between drive belt assembly 12 and idler roller assembly 14, the jam is cleared by moving idler rollers 98, 100 and 102 out of control with the jammed documents in a direction away from belt 40. This is accomplished by manually rotating idler release lever 78 in a clockwise direction (FIGS. 1, 3) through an angle of approximately fifteen degrees. Since idler release lever 78 is fixed to lever arm release pulley 68, pulley 68 also rotates clockwise (FIG. 1) to the same degree. As seen in FIG. 1, this rotation of pulley 68 causes a tension force simultaneously in cables 86, 94 and 96, which force is transferred through the cables to rotate idler roller release pulleys 122, 136 and 154, whereby their attendant idler arms 118, 132 and 150 are rotated and each idler roller 98, 100, 102 is moved to the left (FIG. 1), thereby opening the document path 16 to facilitate removal of the jammed documents. After the jam has been cleared, lever 78 is released, and is moved to its original position under the influence of spring 70. This results in lever arm release pulley 68 returning to its original position, cables 86, 94 and 96 reassume the positions illustrated in FIG. 1, and the operation of the document transport system continues to operate normally as previously described.

Other configurations of the above-described document transport system will be apparent to those skilled in the art, but it is my intent to be only limited by the claims set forth below.

I claim:

1. A document transport system for transporting documents of varying thicknesses along a document path comprising:

document drive assembly means forming one side of said document path, idler roller assembly means forming an opposite side of said document path, said document drive assembly means including moving means adapted to engage said document and move said document along said document path, said idler roller assembly means including idler roller means adapted to move automatically and manually, alternately, between a first position contacting said moving means when no documents are present in said document path and contacting said documents when present in said document path, and a second position out of contact with said moving means on said documents, thereby forming a gap between said idler roller means and said moving means, said idler roller means being connected by lost motion connecting means to idler release lever means, whereby said idler release lever means remains stationary when said idler rollers move automatically between said first position and said second position, and whereby actuation of said idler release lever means causes movement of said idler roller means from said first position to said second position to permit the clearance of jams in said document path, each said idler roller means being disposed for free rotation adjacent one end of idler arm means, the other end of said idler arm means being rigidly connected by means of a shaft supported by said idler roller assembly means to idler roller release pulley means, said lost motion connecting means comprising flexible means operatively extending between said idler release lever means and said idler roller release pulley means, whereby rotative motion of said idler roller release pulley means is not transmitted from said idler roller release pulley means to said idler release lever means.

2. The document transport system of claim 1 wherein deactuation of said idler release lever means causes movement of said idler roller means from said second position to said first position.

3. The document transport system of claim 1 wherein said moving means comprises a driven flexible belt extending substantially along said document path, whereby said idler rollers come into contact with said driven flexible belt when in said first position and no documents are in said document path.

4. The document transport system of claim 3 wherein said documents are firmly engaged between said driven flexible belt and said idler roller means when said documents are transported along said document path.

5. The document transport system of claim 1 wherein said idler release lever means includes lever arm release pulley means rigidly attached to said idler release lever means for movement therewith, and said lost motion connecting means includes flexible cable means extending between said lever arm release pulley and said idler roller release pulley means, whereby movement of said idler release lever means causes movement of said idler roller means from said first position to said second position due to forces applied through said cables.

6. The document transport system of claim 5 wherein said lever release pulley means comprises a plurality of circumferential grooves, said idler roller release pulley means including a pulley connected to each of said shafts, and said flexible cable means including individual cables extending between said lever arm release pulley means and each of said pulleys connected to each of said shafts.

7. The document transport system of claim 1 including spring means associated with each of said shafts which bias said idler roller means toward said first position.

* * * * *